United States Patent [19]

Landa et al.

[11] 4,378,422

[45] Mar. 29, 1983

[54] METHOD AND APPARATUS FOR TRANSFERRING DEVELOPED ELECTROSTATIC IMAGES TO A CARRIER SHEET

[75] Inventors: Benzion Landa, Edmonton, Canada; E. Paul Charlap, Larchmont, N.Y.

[73] Assignee: Savin Corporation, Valhalla, N.Y.

[21] Appl. No.: 249,336

[22] Filed: Mar. 31, 1981

[51] Int. Cl.[3] ..... G03G 13/16

[52] U.S. Cl. ..... 430/126; 430/112; 430/117

[58] Field of Search ..... 430/126, 117, 116, 115, 430/112

[56] References Cited

U.S. PATENT DOCUMENTS 2,825,814 3/1958 Walkup ..... 430/48

2,892,708 6/1959 Walkup ..... 430/126

*Primary Examiner*—John D. Welsh

*Attorney, Agent, or Firm*—Shenier & O'Connor

[57] ABSTRACT

A developed electrostatic image is transferred from a support to a carrier sheet over a gap of between twenty and seventy microns. The gap is formed by dusting onto the developed electrostatic image particles of such size as to form the required gap or by providing protuberances on the insulating support, which may be a photoconductor. The protuberances on the support or the majority of dusted particles are spaced apart by four millimeters or less.

15 Claims, 5 Drawing Figures

FIG. 4
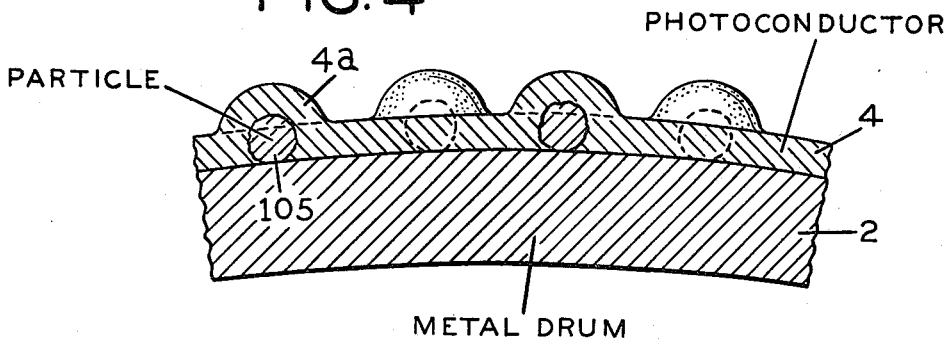
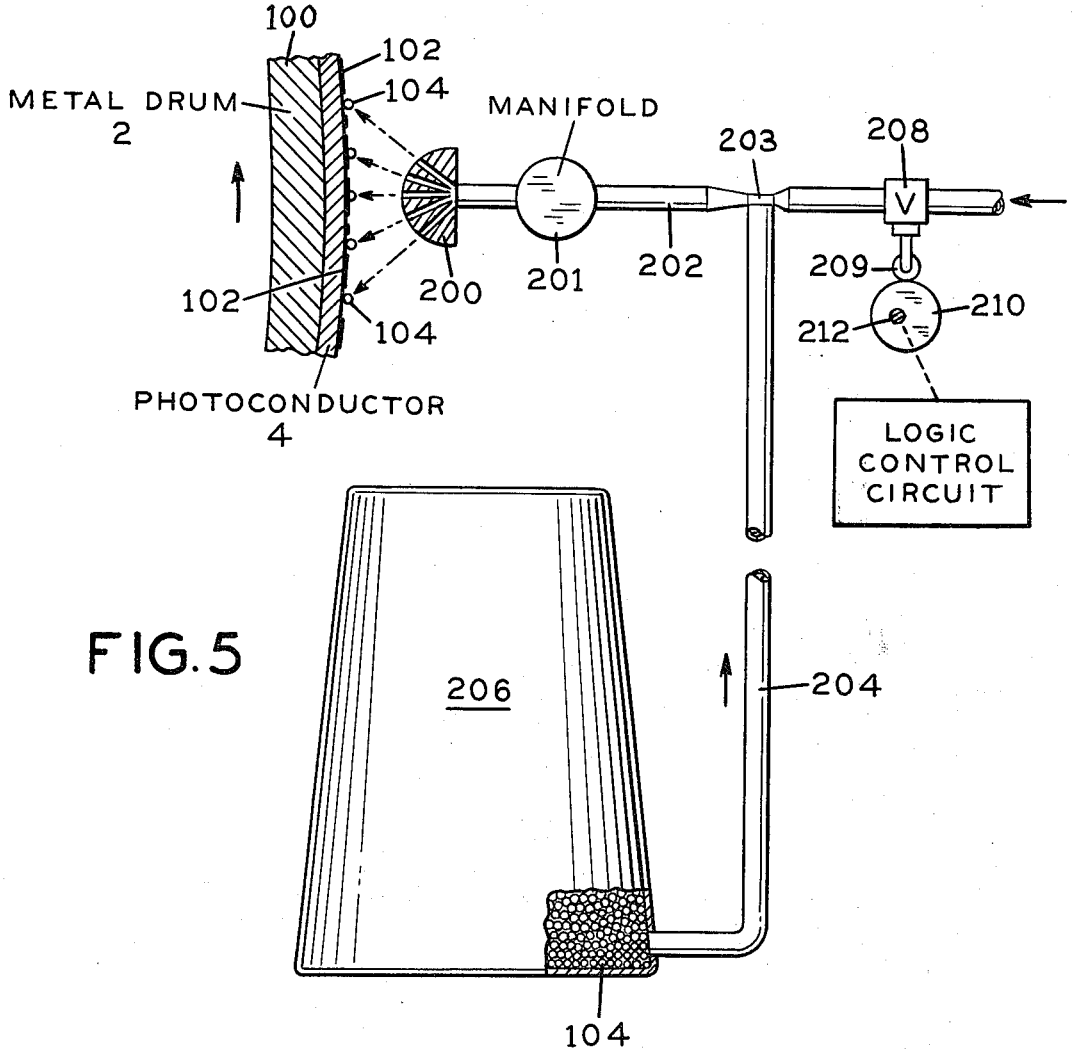
FIG. 5

METHOD AND APPARATUS FOR TRANSFERRING DEVELOPED ELECTROSTATIC IMAGES TO A CARRIER SHEET

CROSS-REFERENCE TO RELATED APPLICATION

This invention is an improvement of a copending application of Benzion Landa for "Improved Process and Apparatus for Transferring Developed Electrostatic Images to a Carrier Sheet, Improved Carrier Sheet for Use in the Process and Method of Making the Same", Ser. No. 149,539, filed May 13, 1980.

BACKGROUND OF THE INVENTION

In the electrophotographic process, a photoconductor is charged in the dark, then exposed to a light image of an original document, drawing, or picture to be copied. In the areas struck by light, the charge is wholly or partially neutralized, depending on the intensity of the light, thus forming a latent electrostatic image on the surface of the photoconductor. If the photoconductor is selenium, the latent image will have a positive electrostatic charge; if the photoconductor is cadmium sulphide, the latent image will have a negative electrostatic charge. The image is then developed by exposing it to charged particles of a toner.

In the processes of the prior art, the developed image has been transferred to a carrier sheet, which may be of any suitable sheet material such as paper, polyester, polyacetate, polycarbonate, or the like. The transfer is accomplished by placing the carrier sheet in contact with the developed electrostatic image and assisting transfer by subjecting the back of the carrier sheet to a potential of a polarity opposite to the charge of the toner particles forming the developed electrostatic image. This will attract the toner particles forming the image to the carrier sheet and effect a transfer of the developed image. If the image is formed of adhesive toner particles, the transfer may be by adhesion after contact, assisted by pressure applied to the rear of the carrier sheet by a roller. This roller may be made of conductive material and biased to a potential having a polarity opposite to the polarity of the charge of the toner particles forming the developed electrostatic image. My process will be described with special reference to a latent electrostatic image which has been developed by electrophoresis of charged toner particles suspended in a dielectric liquid carrier.

The transfer step of the prior art is usually accomplished as pointed out above. This requires contact of the carrier sheet with the freshly developed electrostatic image. In order to accomplish adequate transfer, the developed image must be in a moist condition. If it is too dry, there will be difficulty in transferring the image from the surface of the photoconductor to the carrier sheet. The carrier liquid is usually a non-toxic light paraffinic hydrocarbon, preferably one which has been isomerized so that it will have a very narrow boiling range. Since the freshly developed electrostatic image must be moist, toner is squashed during the transfer by contact with the carrier sheet. This reduces resolution. Since the carrier sheet is usually paper, it will be absorbent. This requires drying of the image, which results in evaporation of the carrier liquid in the circumambient atmosphere. The evaporation of any hydrocarbon into the atmosphere is considered a pollutant, and the amount of evaporation permitted is strictly controlled. This reduces the speed at which an electrophotographic copying machine can be operated. Furthermore, the non-toxic light paraffinic hydrocarbon carrier is expensive and the amount evaporated must be replaced. After the developed image is transferred to a carrier sheet, it will be strongly adhered to the carrier sheet by the polarity of the charge on the rear of the carrier sheet. The charge of the particles, however, is opposite to that of the charge of the latent electrostatic image. The arrangement is such that the paper tends to stick to the photoconductive surface. The greater the density of the developed image, the greater will be the tendency of the carrier sheet to stick to the photoconductive surface. This produces some difficulty in removing the carrier sheet bearing the developed image from the photoconductive surface. The usual carrier sheet is paper, and the repetitive contact of paper with the wet developed image leaves paper fibers on the photoconductive surface. Since all of the developed image is rarely transferred to the carrier sheet, the paper fibers contaminate the developing liquid. Since the contact with the paper squashes the moist developed image, not only is resolution reduced, but the gradation of density, or gray scale, is also reduced.

FIELD OF THE INVENTION

This invention relates to an improved method of developing latent electrostatic images and novel apparatus for carrying out the method.

Description of the Prior Art

Matkan U.S. Pat. No. 3,355,288 discloses a transfer method in which the toner particles forming the image are transferred to a carrier sheet through a volume of liquid between the photoconductor and the carrier sheet to which the image is to be transferred. Matkan discloses three methods of creating the gap. One comprises placing ridges at the edges of the roller over which the carrier sheet passes, to give the required spacing. The second is to mount the roller over which the carrier sheet passes pivotally under the influence of a spring. The roller is thus pressed against a driving belt for the drum carrying the photoconductor, to create a gap. A third method is described as lightly loading the roller over which the carrier sheet passes so that the developer liquid itself keeps the carrier sheet a distance from the surface of the photoconductor, such that transfer of the image takes place through a liquid film. The object of Matkan is to prevent smudging by preventing physical contact between the developed image and the carrier sheet. The bias, in Matkan, is between 50 and 300 volts, which is sufficient to cause charged particles to move by electrophoresis through a liquid.

Defensive Publication of Culhane, No. T869,004, published Dec. 16, 1969, at 869 O.G. 711, relates to a liquid gap transfer of toned electrostatic images and shows three embodiments. The first embodiment involves a flat photoconductor provided along its borders with a pair of shims which space a planar receiver from the photoconductor. A roller is adapted to move across an image receiver and presses it against the shims. The photoconductor is provided with a conductive substrate, and a bias of 1500 volts is impressed between the substrate and the roller. In another embodiment, a drum is provided, having a photoconductive surface, and a receiver is attached to a roller spaced from that surface so as to leave a gap between the receiver and the photoconductive surface. A like bias is impressed across the liquid gap by connecting the axle of the drum carrying the photoconductor and the axle of the roller carrying the receiver. In a third embodiment, the image is carried by a flexible photoconductive web and the receiver is mounted on a rotatable wheel or drum spaced from the web. Sprockets are formed on the rotatable wheel or drum so the receiver will move in synchronism with the flexible photoconductive web. A 1500-volt bias is impressed between the axle of the roller carrying the photoconductive web and the axle of the drum or roller carrying the receiver. Three gaps are disclosed in Culhane—namely, four mils, ten mils, and fourteen mils, corresponding, respectively, to 101.6 microns, 254 microns, and 355.6 microns. If there were any transfer of toned image across a gap this large, the resolution which would be achieved would be so poor as to be of marginal value. It has been discovered that, if the gap from the developed image to the carrier sheet is more than seventy microns, resolution suffers. Conversely, the closer the gap is to the developed image without touching it, the better is the resolution. It is unfeasible to manufacture machines in quantity and have the parallelism between the surface of the photoconductor and the surface of the receiving medium such that the gap between them is always precisely maintained within the desired limits. This is because the accumulated errors introduced by variations in photoconductor and paper thickness, the straightness, eccentricity and location of the photoconductor and the backing roller cannot be predetermined.

Trimmer et al U.S. Pat. No. 3,653,758 and Blenert et al U.S. Pat. No. 3,741,117 both contain the same disclosure. These patents relate to pressureless non-contact electrostatic printing. A printing plate comprises a flexible stainless steel sheet having a thickness of between one-half mil and fifty mils, on which characters formed of dielectric material are mounted, the characters being those which are to be printed. The dielectric characters are then electrostatically charged and toned with dry toner particles. The thus-prepared printing plate is brought to the medium on which the printing is to take place, leaving a gap between $\frac{1}{4}$ inch and 1/32 inch. The rear of the medium is then subjected to a charge of between five kilovolts, or less, and ten kilovolts in any suitable manner. The inventors point out that, if the field intensity of the charge is large enough to cause the developed image to jump the gap, there may be arcing. Such arcing, furthermore, will be induced by variations in the air gap where sharp points might appear. In order to avoid the arcing, the voltage is reduced and the flexible substrate of the printing plate is subjected to ultrasonic vibrations to assist in dislodging the powdered image so that it will jump across the gap created by the reduced charge.

SUMMARY OF THE INVENTION

In general, this invention contemplates a method of transferring a developed image across an air gap which includes the provision of spacer particles positioned between the carrier sheet and the substrate from which the developed image is to be transferred to form a predetermined gap, such that the surface of the carrier sheet is spaced a distance of less than seventy microns from the substrate. Even if the spacer particles are lees than the depth of the developed image, they will serve as a stop to reduce squashing of the developed image by contact with the carrier medium. In carrying out this process, the rear of the carrier sheet is charged with a polarity opposite to the charge of the tone particles making up the developed image so that the developed image, or a portion thereof, will be transferred to the carrier sheet across the gap. Since the substrate supports spacing means adapted to extend between the carrier sheet and the surface of the photoconductor, the gap is maintained irrespective of manufacturing tolerances in the apparatus for carrying out this process. Spacing particles are provided by depositing them on the freshly developed latent image, or spacing is provided by deforming the photoconductor. to provide spacing projections. Novel apparatus, positioned between the excess liquid-developer removal station and the transfer station for dusting spacing particles onto the photoconductor bearing the freshly developed image, is also provided.

OBJECTS OF THE INVENTION

One object of this invention is to provide a method of transferring an electrostatic image which has been developed by a liquid-carried toner from a photoconductor to a carrier sheet across a predetermined gap such that the only liquid which is transferred to the carrier sheet is that entrained in the liquid-developed image which has been transferred to the carrier sheet.

Another object of this invention is to provide a method of transferring a developed electrostatic image across an air gap to a carrier sheet which is supported by spacing particles carried by the photoconductor to form the gap.

Still another object of this invention is to provide a method of transferring a developed electrostatic image across an air gap to a carrier sheet which is supported by spacing particles dusted on the photoconductor to form the gap.

A further object of this invention is to provide a method of spacing a carrier sheet from a freshly developed image to form an air gap across which the image is to be transferred in which the carrier sheet may be more readily and easily removed from the photoconductor after transfer of the image.

A still further object of this invention is to provide a process adapted to receive a developed electrostatic image across an air gap to a carrier sheet in which the transferred image is not smudged or smeared.

An additional object of this invention is to provide a process in which a freshly developed liquid-toned electrostatic image is transferred across a gap between the image and the carrier sheet in which the developer liquid may have a high concentration of toner particles to produce a denser image.

Still another object of this invention is to provide a process for transferring a freshly developed electrostatic image to a carrier sheet across a predetermined gap so that the developed image will not be smeared, thus producing an image of high resolution.

Other and further objects of this invention will appear from the following description.

BRIEF DESCRIPTION OF THE DRAWINGS

FIG. 4 is a fragmentary sectional view, drawn on an enlarged scale, showing another form of providing spacing means between the freshly developed electrostatic image and the carrier sheet.

FIG. 5 is a diagrammatic view, drawn on an enlarged scale, of the dusting means for depositing spacing particles on the developed electrostatic image just before it reaches the transfer station.

DESCRIPTION OF THE PREFERRED EMBODIMENT

Figure 1:
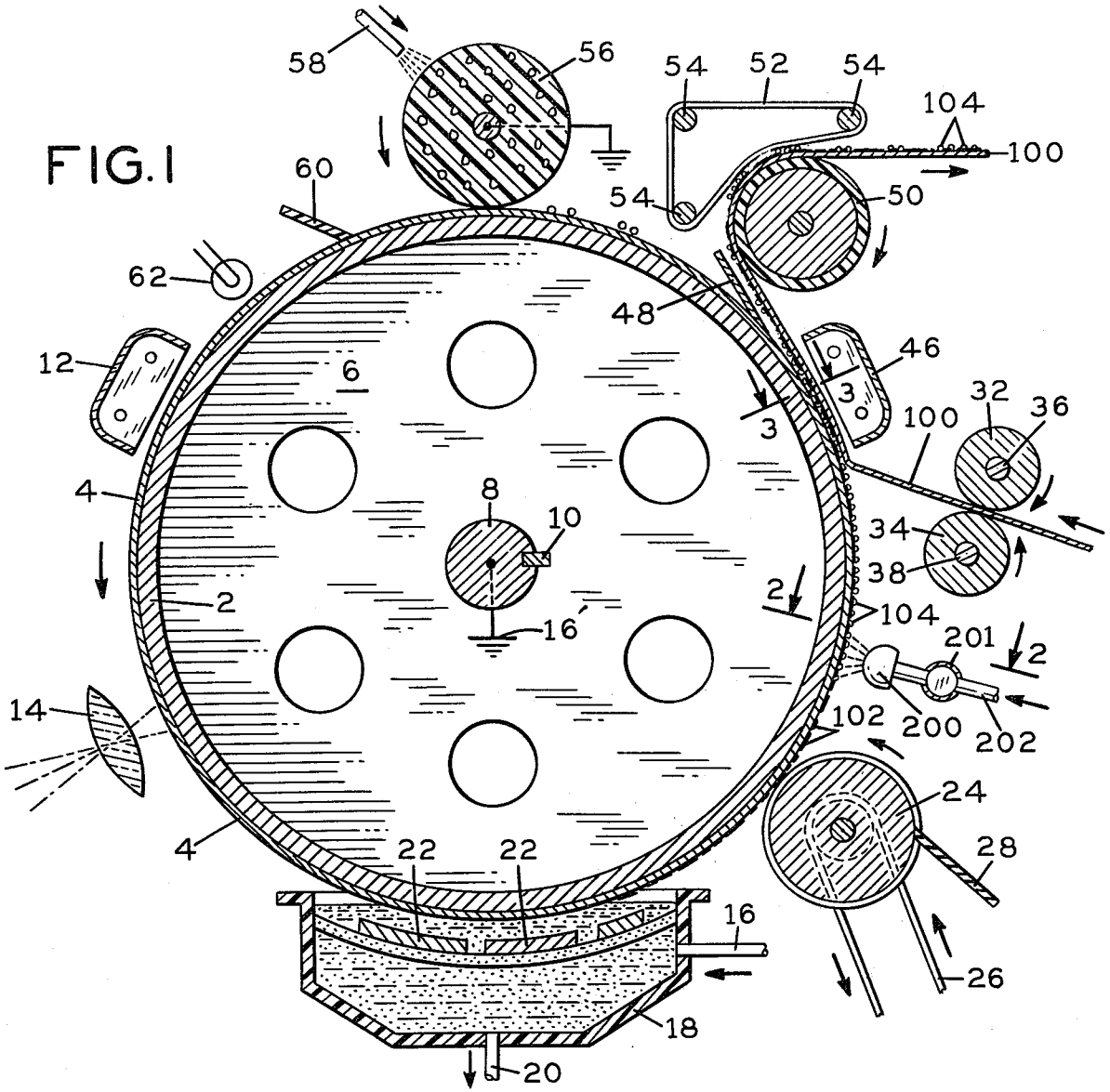
FIG. 1 is a diagrammatic view of one form of novel apparatus capable of carrying out the improved method of this invention.

More particularly, referring now to the drawings, a metal drum 2, shown in FIG. 1, carries a photoconductor 4 and is mounted by disks 6 on a shaft 8 to which the disks are secured by a key 10 so that the assembly will rotate with the shaft 8. This shaft is driven in any appropriate manner (not shown) in the direction of the arrow past a corona discharge device 12 adapted to charge the surface of the photoconductor 4, it being understood that the assembly is in a lightproof housing (not shown). The image to be reproduced is focused by a lens 14 upon the charged photoconductor. Since the shaft 8 is grounded at 16' and the disks 6 are conductive, the areas struck by light will conduct the charge, or a portion thereof, to ground, thus forming a latent electrostatic image. A developing liquid, comprising an insulating carrier liquid and toner particles, is circulated from any suitable source (not shown) through pipe 16 into a development tray 18 from which it is drawn through pipe 20 for recirculation. Development electrodes 22, which may be appropriately biased as known to the art, assist in toning the latent electrostatic image as it passes in contact with the developing liquid. Charged toner particles, disseminated through the carrier liquid, pass by electrophoresis to the latent electrostatic image, it being understood that the charge of the particles is opposite in polarity to the charge on the photoconductor 4. If the photoconductor is selenium, the corona charge will be positive and the toner particles will be negatively charged. If the photoconductor is made of cadmium sulphide, the charge will be negative and the toner particles will carry a positive charge. The amount of liquid on the surface of the photoconductor is normally too great. Accordingly, a roller 24 whose surface rotates in a direction opposite to the direction of rotation of the photoconductor, spaced from the surface of the photoconductor, is adapted to shear excess liquid from the developed image without disturbing the image. This roller is shown in Hayashi et al U.S. Pat. No. 3,907,423. It is driven by any appropriate means, such as by drive belt 26, and kept clean by a wiper blade 28. The drive belt 26 is driven by any appropriate speed-controllable means (not shown since such is known to the art). Instead of by a doctor roller, just described, the excess developing liquid may be removed from the photoconductive surface by the method and apparatus shown in Landa et al application Ser. No. 39,373, filed May 15, 1979, for "Method and Apparatus for Removing Excess Developing Liquid from Photoconductive Surfaces", now U.S. Pat. No. 4,286,039. This shows an excess-liquid absorbing roller or a squeegee excess-liquid remover. Of course, any other liquid-metering technique known to the art may be employed.

Figure 2:
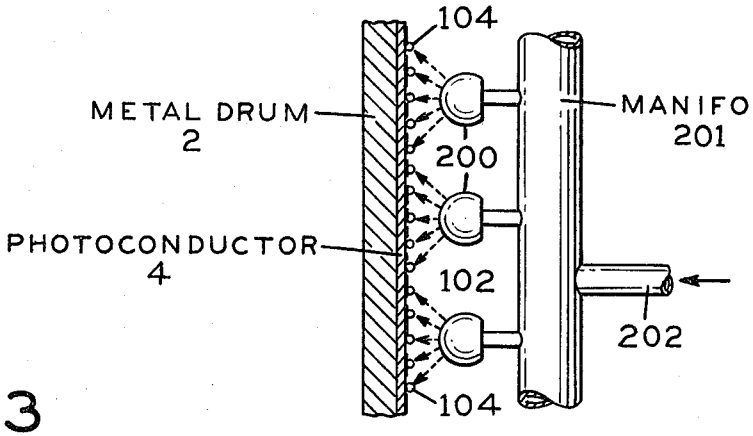
FIG. 2 is a fragmentary sectional view, drawn on an enlarged scale, taken along the line 2—2 of FIG. 1.

The freshly developed image-carrying surface is then dusted with spacing particles applied in any appropriate manner, such as electrostatic spraying, mechanical dusting, or any other means known to the art. One form of apparatus for dusting the image is shown in FIGS. 2 and 5.

Referring now to FIG. 5, a receptacle 206 contains particles, preferably made of any suitably-sized material such as polyacrylic particles or natural starches. The specific dusting material is not critical. It must be large enough, however, to space the carrier sheet to which the image is to be transferred from the surface of the photoconductor by a distance of between four microns and seventy microns in order to form the desired gap over which the developed image is to be transferred. The particles may have any shape, such as pyramidal, spherical, cubical, or random. Any material, such as glass, polyester resin, polyethylene, polycarbonate, or the like, may be employed for the dusting material. A gas, such as air, from a relatively low pressure source, such as a centrifugal blower, flows through a pipe 202 under the control of a valve 208 into a manifold 201. The manifold 201 communicates with a plurality of nozzles 200 spaced adjacent to and extending across the axis of rotation of the photoconductor, as can readily be seen by reference to FIG. 2. A pipe 204 communicates with the particles 104 in the receptacle 206 to a Venturi 203 in the pipe 202 so as to induce a flow of particles 104 into the pipe 202 and thence to the manifold 201 from which dust particles entrained in the gas will pass to the nozzles 200. The dust particles will provide spacing means between the photoconductor 4 and the carrier sheet 100 to which the image is to be transferred. It is to be understood, of course, that the receptacle 206 may be positioned above the pipe 202 so that dust particles will tend to flow down pipe 204 by gravity. It is also to be understood that the particles in pipe 204 may be gaseously fluidized. It will be further understood that the freshly developed image 102 is dusted with spacing particles only during its passage from the doctor roller 24 to the transfer station where corona 46 is positioned. In order to ensure that the dusting operation takes place only during this period of time, the valve 208 is provided with a cam follower 209 bearing against cam 210 carried by a shaft 212. This shaft is rotated by any appropriate means (not shown) under control of a logic circuit which will time the opening of the valve in synchronism with the passage of the developed image from the doctor roller to the transfer station. Such logic or timing circuits are well-known to the art and hence are not shown in detail.

Referring again to FIG. 1, a pair of register rolls 32 and 34 are adapted to feed the carrier sheet 100, which is to receive the developed image, toward the photoconductor. The register rolls 32 and 34 are mounted on axles 36 and 38 to which the register rolls are secured for rotation therewith. The axles are driven in synchronism so that there is no relative motion between the points of closest approach of the rolls 32 and 34 to each other. If desired, only one of the register rolls need be driven. The register rolls are adapted to feed the carrier sheet 100, which is to receive the developed image, to the transfer station. The corona discharge device 46 is adapted to impress a charge upon the rear of the carrier sheet 100 of a polarity opposite to the polarity of the toner particles forming the developed image so as to draw the developed image toward the carrier sheet. A pick-off member 48 assists in the removal of the carrier sheet bearing the developed image from the photoconductor. A roller 50, coacting with a plurality of flexible bands 52, delivers the carrier sheet to an exit tray (not shown). The flexible bands are mounted on a plurality of rollers 54, as shown in FIG. 1. A cleaning roller 56, formed of any appropriate synthetic resin, is driven in a direction opposite to the direction of rotation of the photoconductor to scrub the surface of the photoconductor clean. To assist in this action, developing liquid may be fed through pipe 58 to the surface of the cleaning roller 56. A wiper blade 60 completes the cleaning of the photoconductive surface. Any residual charge left on the photoconductive drum is extinguished by flooding the photoconductor with light from lamp 62.

Figure 3:
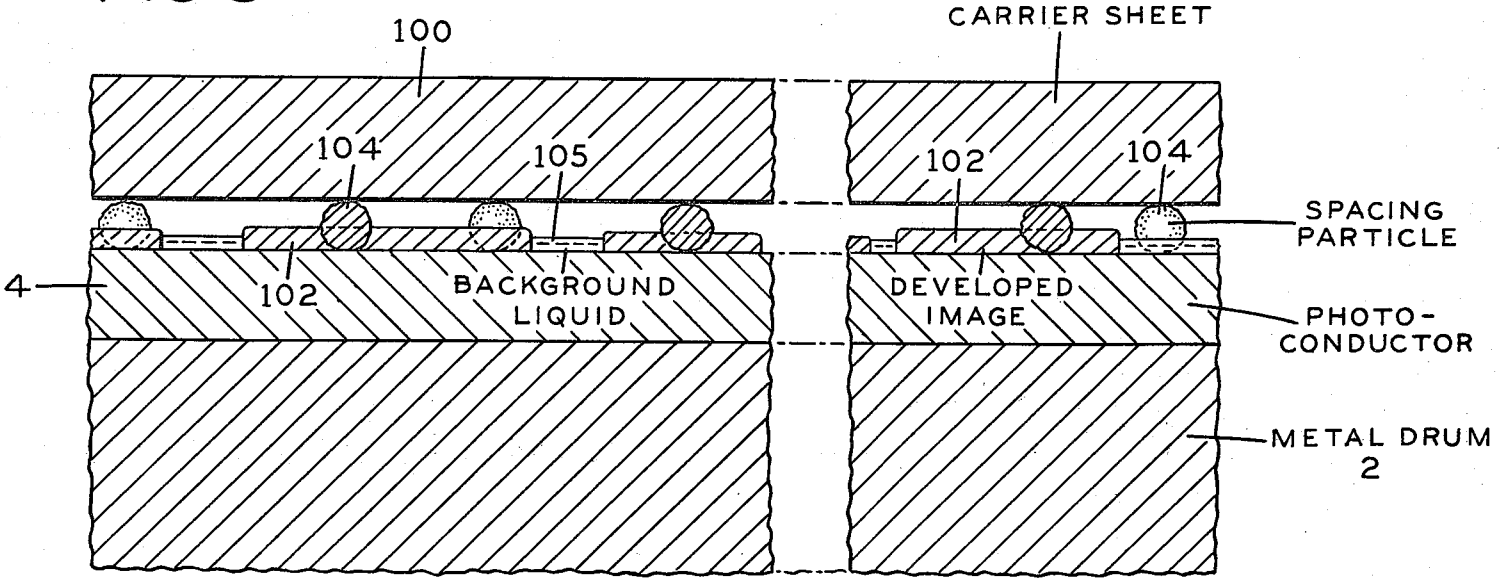
FIG. 3 is a fragmentary sectional view, drawn on an enlarged scale, taken along the line 3—3 of FIG. 1.

Referring now to FIG. 3, it is to be understood that the carrier sheet 100 may be made of paper or other material. The gap formed between the under-surface of the carrier sheet 100 and the surface of the photoconductor may vary between four and seventy microns. It is to be understood, of course, that the thickness of the carrier sheet may vary within wide limits, depending on the weight of the paper. If the gap between the image and the carrier sheet exceeds seventy microns, resolution is degraded. The developed image, of course, will vary in thickness, depending on the density of the original being reproduced. The blacker the original, the thicker will be the image. Even if the image is thicker than four microns, spacing particles of four microns will prevent complete squashing of the developed image, so that a remarkable improvement is still obtained. This process produces a gray scale; that is, the image produced will vary to reflect the degree of density of the original being copied. The thickness of the developed image may vary between four and fifteen microns. Even though the amount of liquid developer is reduced, there will be liquid on the photoconductor on the non-image or background areas of two microns or more. The interparticle distance may vary. Preferably, the interparticle spacing should be four millimeters or less. The gap and the spacing means perform two exceedingly important functions. First, the resolution is increased, since the image is not smeared or squeezed by contact of the carrier sheet with the image. Secondly, in the case of a liquid-developed image, the amount of liquid touching the paper is reduced to a minimum, since only that entrained in the image being transferred will be absorbed by the paper. This tremendously reduces pollution, since the surface area actually contacted with liquid is minute.

Referring now to FIG. 4, as has been noted above, the distance between individual spacing means advantageously should be less than four millimeters. The control of this distance is not always possible with the dusting method described hereinabove. Particles may be positioned around the metal drum 2 with the desired interparticle spacing by any appropriate method. These particles form nuclei over which photoconductive material may be deposited on the metal drum 2. The finished photoconductor will be furnished with blunter or rounded protuberances 4*a*. The size of the inert particles 105 should be such that the radius of the protuberances 4*a*, formed on the photoconductor, should be seventy microns or less and have interprotuberant spacing, as pointed out above, of four millimeters or less.

The image produced on the carrier sheet of this invention has greatly increased resolution, since there is no squashing effect of the image due to the air gap. Thin lines are shown with greatly improved density. Not only is the resolution of the image good, but a gray scale appears. This enables photographs to be copied with much higher fidelity than is usually possible with an electrophotographic copying machine. As will be pointed out hereinafter, the area occupied by the protuberances is so small that, not only are they not noticeable, but a very minute portion of the area of the carrier sheet will be wetted with liquid when a liquid toner is used. Furthermore, the spacing means or protuberances, aid in removing the carrier sheet from the photoconductor, since there is a space between the photoconductor and the carrier sheet. Since there is very minor contact between a paper carrier sheet and the photoconductor, the developer fluid does not become contaminated with paper fibers. A higher concentration of toner in respect of the carrier liquid is advantageously used. The higher the concentration of toner particles in a developer liquid, the longer will a carrier liquid last in use without deterioration. Stated otherwise, weak concentrations of toner particles in a carrier liquid deteriorate more rapidly. Liquid developers have been used in which the toner particles were concentrated to between four and ten percent. The concentration of the toner particles for use in this process may be readily determined empirically. The factors to be considered are the percentage of moisture in the developed image, the height of the potential of the charge of the charged toner particles, the distance of the gap between the carrier sheet and the photoconductor (which in this invention is predetermined), and the potential of the charge behind the carrier sheet inducing the transfer of the developed image through the gap to the carrier sheet. There are a number of toners available in the commercial market for liquid-developing electrostatic images. They all comprise a dielectric carrier liquid and charged toner particles disseminated therethrough.

It is important that the developed image be moist. If the image is too dry, a difficulty in transfer over the gap will result. A corona charge of between $5\frac{1}{2}$ and 7 kilovolts has been used behind the carrier sheet to effect transfer. If too high a voltage is used, arcing may result. The amount of carrier liquid left in the developed image can be controlled by the reverse roller 24, shown in FIG. 1 or by other appropriate means, as pointed out above. Both the spacing of the roller and the speed of rotation are factors to be considered. The percentage of liquid left in the developed image is a function of the spacing of the reverse roller from the image and the speed at which the reverse roller rotates. Since the distance between the surface of the reverse roller and the surface of the photoconductor is usually fixed by the construction of the reverse roller, it is a simple matter, by a speed control on the reverse roller drive, to control its rate of rotation and, hence, the degree of moisture (referring to the carrier liquid) left in the developed image. One of the salient advantages of this method is that there is a very minute amount of carrier liquid transported to the carrier sheet for evaporation into the circumambient atmosphere. It has been indicated that, if a gap exceeds seventy microns, there is a loss of resolution in the transferred image.

It will be seen that the objects of this invention have been accomplished. This invention has provided a method of transferring an electrostatic image which has been developed by a liquid-carried toner to a carrier sheet such that substantially the only liquid which is transferred to the carrier sheet is that entrained in the developed image. This invention has provided a method of transferring a developed electrostatic image across a gap to a carrier sheet from a support which carries gap-forming means. This invention has provided apparatus for spacing a carrier sheet from a freshly developed electrostatic image on the support carrying the image so that the image can be transferred across the gap, whereby the carrier sheet may more readily and easily be removed from the support carrying the developed image. This invention has provided a method of forming a gap between the developed image and the carrier sheet to which the image is to be transferred so that the transferred image is not smudged or smeared, whereby to produce an image of high resolution. This invention has provided a novel apparatus for forming a gap between a support on which a latent electrostatic image is formed and a carrier sheet to which the image is to be transferred. The method and apparatus of this invention prevent the carrier sheet from absorbing a major amount of carrier liquid and thus reduce pollution which may be induced by evaporation of the carrier liquid. The image quality is greatly sharpened, since smudging, smearing, and squashing are avoided. Copies may be made on any paper, including rough paper, since the developed image will negotiate the gap. This makes the roughness of the paper less relevant.

It will be understood that certain features and subcombinations are of utility and may be employed without reference to other features and subcombinations. This is contemplated by and is within the scope of the claims. It is further obvious that various changes may be made in details within the scope of the claims without departing from the spirit of this invention. It is, therefore, to be understood that this invention is not to be limited to the specific details shown and described.

The invention having been thus described, what is claimed is:

1. A method of electrophotography including the steps of forming a latent electrostatic image on a photoconductive surface, developing the image on said surface with charged toner particles dispersed in a liquid carrier, dusting the developed image with spacing particles adapted to form a gap between the photoconductive surface and a sheet to which the developed image is to be transferred, positioning said sheet for support by said spacing particles, and then applying a potential of a polarity opposite to the charge of said toner particles to the back of said sheet to cause said developed image to be transferred from the photoconductor to said sheet.

2. A method of electrophotography including the steps of forming a latent electrostatic image on a photoconductive surface, developing the image on said surface with charged toner particles dispersed in a liquid carrier, dusting the developed image with spacing particles adapted to form a gap between the photoconductive surface and a sheet to which the developed image is to be transferred, said spacing particles having a diameter of between twenty microns and seventy microns, positioning said sheet for support by said spacing particles, and then applying a potential of a polarity opposite to the charge of said toner particles to the back of said sheet to cause said developed image to be transferred from the photoconductor to said sheet.

3. A method of electrography including the steps of forming a latent electrostatic image on an insulating surface, developing the image on said surface with charged toner particles dispersed in a liquid carrier, dusting the developed image with spacing particles having a diameter of between twenty microns and seventy microns adapted to form a gap between the insulating surface and a sheet to which the developed image is to be transferred, the majority of such particles being spaced apart by less than four millimeters, positioning said sheet for support by said spacing particles, and then applying a potential of a polarity opposite to the charge of said toner particles to the back of said sheet to cause said developed image to be transferred from the insulating surface to said sheet.

4. A method of transferring a developed electrostatic image from an insulating surface including the steps of developing a latent electrostatic image on said surface with charged toner particles dispersed in a liquid carrier, dusting the developed image with spacing particles adapted to form a gap of between twenty microns and seventy microns between the insulating surface and a sheet to which the developed image is to be transferred, supporting said sheet by said spacing particles, and then applying a potential of a polarity opposite to the charge of said toner particles to the back of said sheet to cause said developed image to be transferred from the insulating surface to said sheet.

5. A method of transferring a developed electrostatic image from an insulating surface including the steps of developing a latent electrostatic image on said surface with charged toner particles dispersed in a liquid carrier, providing said insulating surface with spacing elements dispersed over the area of said surface and adapted to form a gap of between twenty microns and seventy microns between said insulating surface and a sheet to which the developed image is to be transferred, positioning said sheet for support by said spacing elements, the majority of said elements being spaced apart by less than four millimeters, and then applying a potential of a polarity opposite to the charge of said toner particles to the back of said sheet to cause said developed image to be transferred from the insulating surface to said sheet.

6. A method as in claim 5 in which said dispersed spacing elements comprise particles dusted onto said insulating surface.

7. A method as in claim 5 in which said dispersed spacing elements comprise protuberances formed on said insulating surface.

8. A method as in claim 5 in which said insulating surface is a photoconductor.

9. Apparatus for transferring developed electrostatic images from a support to a carrier sheet including in combination an insulating support, means for forming a latent electrostatic image on said support, developing means for applying liquid-carried charged toner particles to said latent image to form a developed electrostatic image, means for dusting said developed image with spacing particles adapted to form a gap between said insulating support and the carrier sheet, and means for applying a potential opposite to the charge of the toner particles to the back of said carrier sheet whereby to transfer said developed image from said support to said sheet.

10. Apparatus for transferring developed electrostatic images from a support to a sheet including in combination a support having an insulating surface, means for forming a latent electrostatic image on said insulating surface, developing means for applying liquid-carried charged toner particles to said latent image to form a developed electrostatic image, means for forming a gap of between twenty microns and seventy microns between said insulating surface and the sheet, and means for applying a potential opposite to the charge of the toner particles to the back of said sheet whereby to transfer said developed image from said support to said sheet.

11. Apparatus as in claim 10 in which said gap-forming means comprises means for dusting the developed image with spacing particles.

12. Apparatus as in claim 10 in which said gap-forming means comprises protuberances formed on said insulating surface.

13. Apparatus as in claim 10 in which said gap-forming means comprises means for dusting the developed image with spacing particles, the majority of said particles being spaced apart by less than four millimeters.

14. Apparatus as in claim 10 in which said gap-forming means comprises protuberances formed on said insulating surface, said protuberances being spaced apart by less than four millimeters.

15. A method of electrography including the steps of forming a latent electrostatic image on an insulating surface, developing the image on said surface with charged toner particles dispersed in a liquid carrier, dusting the developed image with spacing particles having a diameter of between six microns and sixty microns adapted to form a gap between the insulating surface and a sheet to which the developed image is to be transferred, the majority of such particles being spaced apart by less than four millimeters, positioning said sheet for support by said spacing particles, and then applying a potential of a polarity opposite to the charge of said toner particles to the back of said sheet to cause said developed image to be transferred from the insulating surface to said sheet.

* * * * *